US007758456B1

(12) United States Patent
Dykes

(10) Patent No.: US 7,758,456 B1
(45) Date of Patent: Jul. 20, 2010

(54) ILLUMINABLE BASKETBALL RIM ASSEMBLY AND ASSOCIATED METHOD

(76) Inventor: Lamaar Dykes, 51 Long St., East Orange, NJ (US) 07017

( * ) Notice: Subject to any disclaimer, the term of this patent is extended or adjusted under 35 U.S.C. 154(b) by 303 days.

(21) Appl. No.: 12/074,991

(22) Filed: Mar. 10, 2008

(51) Int. Cl.
*A63B 63/08* (2006.01)

(52) U.S. Cl. ..... 473/479; D21/702

(58) Field of Classification Search ..... 473/479, 473/485, 481; D21/702; 362/253
See application file for complete search history.

(56) References Cited

U.S. PATENT DOCUMENTS 3,841,631 A * 10/1974 Dolan ..... 473/481
5,305,998 A * 4/1994 Nesbit et al. ..... 473/481
5,346,207 A * 9/1994 Heinen ..... 473/481
5,370,390 A * 12/1994 Swanson ..... 473/410
5,833,558 A * 11/1998 Pettle ..... 473/479
5,916,048 A * 6/1999 Hurell et al. ..... 473/479
6,554,724 B2 * 4/2003 Taylor ..... 473/447
6,582,329 B1 * 6/2003 Cabrera ..... 473/480
2008/0176679 A1 * 7/2008 Chin ..... 473/481

* cited by examiner

*Primary Examiner*—Gene Kim
*Assistant Examiner*—M Chambers

(57) ABSTRACT

An illuminable basketball rim assembly includes an anchor member that has a hollow cavity filled with a weight agent. A support pole is coupled to the anchor member and extends upwardly therefrom, and has a distal end positioned anterior to the anchor member. A rim section is positioned at the distal end of the support pole. A mechanism illuminates the rim section and the support pole when an external force is applied to the rim section. A mechanism maintains the support pole at a stable and equilibrium position such that the distal end of the support pole is prohibited from displacing downwardly beyond a predefined height.

16 Claims, 15 Drawing Sheets

ILLUMINABLE BASKETBALL RIM ASSEMBLY AND ASSOCIATED METHOD

CROSS REFERENCE TO RELATED APPLICATIONS

This application claims the benefit of U.S. Provisional Application No. 60/772,962, filed Feb. 13, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to portable basketball rims and, more particularly, to an illuminable portable basketball rim that does not employ a backboard.

2. Prior Art

The game of basketball is played by many people throughout the United States and the world. Briefly, the game of basketball includes a flat and level playing surface with a basketball goal at each end of the court. The basketball goal typically includes a support pole with a backboard and rim or hoop attached to the top of the support pole. The rim or hoop is normally located ten feet above the playing surface and the backboard is constructed from materials such as tempered glass.

Conventional basketball goals include rigidly mounting the hoop to the basketball backboard so that the face of the backboard is positioned perpendicular to the playing surface and the hoop is positioned parallel to the playing surface. The mounting of the hoop to the backboard must be sufficiently rigid so that the hoop is capable of withstanding various forces and impacts during the game of basketball. For example, the hoop must remain in a generally stationary position so that the basketball rebounds and bounces off the rim in a consistent, dependable manner. In addition, the hoop must be able to withstand various impacts by the players during the game.

One prior art example shows a basketball goal system that may include a backboard, an elongated support that positions the backboard above a playing surface, a backboard support assembly that connects the backboard to the elongated support, and a goal support assembly with a rim and a support member. Preferably the support member is attached to the backboard support assembly behind a plane that is generally aligned with the front surface of the backboard. In addition, the basketball goal system may include a resistance mechanism to create a breakaway type basketball rim. The resistance mechanism is also preferably positioned behind a plane that is generally aligned with the front surface of the backboard. Advantageously, the basketball goal system may be part of a portable basketball system and/or a basketball system in which the height of the backboard and rim is adjustable relative to the playing surface. Unfortunately, this prior art example does not provide an illuminable rim for allowing a player to use the rim during low light conditions. In addition, due to the number of elements involved, the assembly of this invention is complicated and difficult.

Another prior art example shows a breakaway basketball rim assembly in which the mounting bracket and rim are operably interconnected by a torsion rod which twists resiliently in response to an impact or other downward load on the rim. The torsion rod may extend parallel to the backboard, with one end being mounted to the mounting bracket and the other end being mounted to the rim, so that the torsion rod allows the rim to deflect downwardly about an axis that extends parallel to the backboard. The torsion rod may be mounted to overlapping flanges on the mounting bracket and the rim. There may also be a longitudinal torsion rod that extends perpendicular to the transverse torsion rod, so as to permit the rim to deflect downwardly about axes that extend both parallel and perpendicular to the backboard. Also provided is a structure for attaching the net to the rim member, in which there is a depending flange on the lower edge of the rim and a plurality of through openings having projections which receive and hold the attachment loops on the net. Unfortunately, this prior art example also does not provide an illuminable rim. In addition, this example does not allow a user to attach the rim to the support pole through the use of a magnetized attachment pin.

Accordingly, a need remains for an illuminable portable basketball rim that does not employ a backboard to overcome the aforementioned prior art shortcomings. The present invention satisfies such a need by providing an assembly that is convenient and easy to use, lightweight yet durable in design, and provides an illuminable portable basketball rim that does not employ a backboard. Such a rim provides players with a new and unique means of enjoying the game of basketball. Attached to an eye-catching, curved goal post without a blackboard, the rim offers a festive means of injecting fun and flash into a game of basketball. The rim allows players to use the rim during low light conditions, and can be assembled virtually anywhere. The rim is simple to use, portable, inexpensive, and designed for many years of repeated use.

BRIEF SUMMARY OF THE INVENTION

In view of the foregoing background, it is therefore an object of the present invention to provide an assembly for an illuminable portable basketball rim that does not employ a backboard. These and other objects, features, and advantages of the invention are provided by an illuminable basketball rim assembly for providing user enjoyment in space-limited areas.

The assembly includes an anchor member seated on a ground surface that has a hollow cavity filled with a weight agent. A curvilinear and resiliently adaptable support pole is directly coupled to the anchor member and advantageously extends upwardly therefrom. Such a support pole has a distal end conveniently positioned anterior to the anchor member. Such a distal end effectively maintains at least a minimum spatial distance with the ground surface during operating conditions such that an arcuate portion of the support pole does not downwardly bend beyond a minimum height effectively defined between the distal portion and the ground surface. A rim section is magnetically attached to the distal end of the support pole.

The assembly further includes a mechanism for effectively illuminating the rim section and the support pole when an external force is applied to the rim section. The rim section and the support pole illuminating mechanism includes a first plurality of illuminable elements effectively embedded within the rim section and traveling about an entire circumference thereof. A second plurality of illuminable elements is effectively embedded within the support pole and travels along a major longitudinal length thereof. An elongated flange advantageously extends rearwardly from the rim section and has a posterior end adjustably seated within the distal end of the support pole. First and second deformably resilient spring members are conveniently nested within the support pole and attached directly to the flange to thereby advantageously maintain the rim section at the equilibrium position effectively defined centrally within the support pole.

The rim section and the support pole illuminating mechanism further includes an extension member statically anchored directly to the flange and extending rearwardly therefrom while seated within the support pole, and an actuating arm pivotally housed within the support pole and directly coupled to the extension member. First and second conductive contacts are statically disposed within the support pole and equidistantly spaced from the actuating arm when the actuating arm is rested at the equilibrium position. Such first and second spring members respectively effectively compress and expand when the external force acts upon the rim section to thereby advantageously pivot the actuating arm about an axis effectively defined perpendicular to the flange and conveniently engage one of the first and second conductive contacts so that a continuous electrical connection is effectively created between the first and second plurality of illuminable elements.

A mechanism advantageously maintains the support pole at a stable and equilibrium position such that the distal end of the support pole is effectively prohibited from displacing downwardly beyond a predefined height. Such a support pole maintaining mechanism includes a rectilinear shaft including telescopically engaged male and female members. Each of such male and female members includes a distal end pivotally attached to the support pole such that a longitudinal length of the shaft is advantageously maintained at a fixed position during operating conditions for effectively prohibiting the support pole from bending beyond a predetermined threshold. The distal end of the male member is conveniently disposed proximate to the distal end of the support pole.

A method for illuminating a basketball rim assembly includes the steps of seating an anchor member on a ground surface, and directly coupling a curvilinear and resiliently adaptable support pole to the anchor member and extending the support pole upwardly therefrom. The anchor member has a hollow cavity filled with a weight agent, and the support pole has a distal end positioned anterior to the anchor member. The distal end of the support pole maintains at least a minimum spatial distance with the ground surface during operating conditions such that an arcuate portion of the support pole does not downwardly bend beyond a minimum height defined between the distal portion and the ground surface. The method further includes the steps of positioning a rim section at the distal end of the support pole, illuminating the rim section and the support pole by applying an external force to the rim section, and maintaining the support pole at a stable and equilibrium position such that the distal end of the support pole is prohibited from displacing downwardly beyond a predefined height.

The method further includes the steps of, providing a first plurality of illuminable elements embedded within the rim section and traveling about an entire circumference thereof, providing a second plurality of illuminable elements embedded within the support pole and traveling along a major longitudinal length thereof, providing an elongated flange extending rearwardly from the rim section that has a posterior end adjustably seated within the distal end of the support pole, and providing first and second deformably resilient spring members nested within the support pole and attached directly to the flange to thereby maintain the rim section at the equilibrium position defined centrally within the support pole.

The method further includes the steps of providing an extension member statically anchored directly to the flange and extending rearwardly therefrom while seated within the support pole, providing an actuating arm pivotally housed within the support pole and directly coupled to the extension member, and providing first and second conductive contacts statically disposed within the support pole and equidistantly spaced from the actuating arm when the actuating arm is rested at the equilibrium position. Such first and second spring members respectively compress and expand when the external force acts upon the rim section to thereby pivot the actuating arm about an axis defined perpendicular to the flange and engage one of the first and second conductive contacts so that a continuous electrical connection is created between the first and second plurality of illuminable elements.

The method further includes the steps of providing a rectilinear shaft by telescopically engaging male and female members. Each of such male and female members includes a distal end pivotally attached to the support pole such that a longitudinal length of the shaft is maintained at a fixed position during operating conditions for prohibiting the support pole from bending beyond a predetermined threshold.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
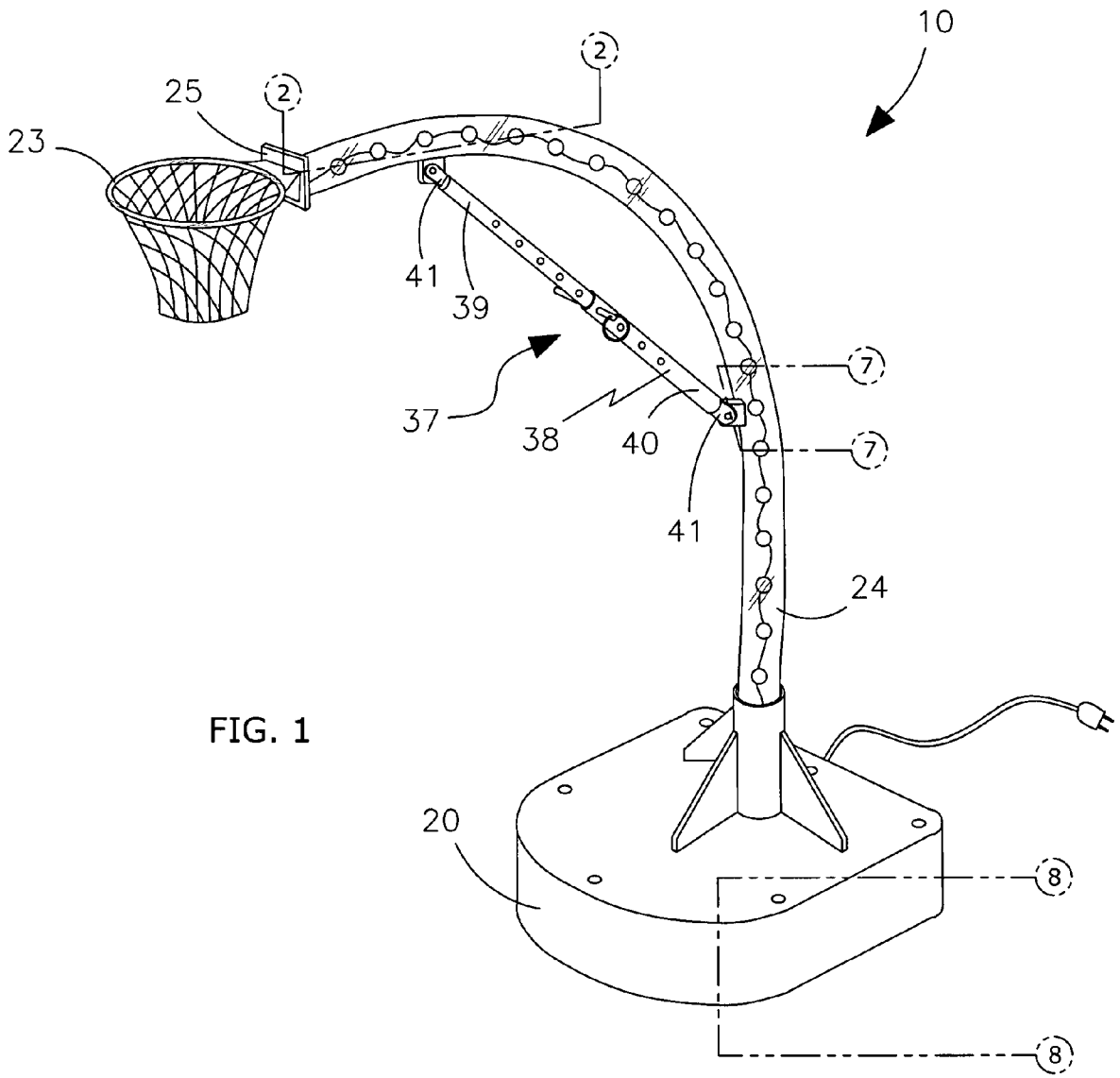
FIG. 1 is a perspective view of an illuminable portable basketball rim assembly, in a preferred embodiment, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1-15 by the reference numeral 10 and 10' is intended to provide an illuminable portable basketball rim that does not employ a backboard. It should be understood that the assembly 10 and 10' may be used in various environments and should not be construed as limited to an outdoor basketball rim assembly.

Referring to FIGS. 1, 2, 3, 4, 5, 6, 8, 9 and 14, the assembly 10 and 10' includes an anchor member 20 seated on a ground surface that has a hollow cavity 21 filled with a weight agent. Such a weight agent maintains the assembly 10 in a substantially vertical position, which is necessary such that the rim section 23 (herein described below) is maintained at a sufficient height above the ground surface. In addition, such a weight agent 22 prevents premature and undesirable shifting of the anchor member 20 along the ground surface during operating conditions.

Referring to FIGS. 1, 2, 3, 4, 5, 7, 9, 10, 12 and 15, a curvilinear and resiliently adaptable support pole 24 is directly coupled to the anchor member 20, without the use of intervening elements, and advantageously extends upwardly therefrom. Such a support pole 24 has a distal end 25 positioned anterior to the anchor member 20, which is vital for eliminating the possibility of an airborne user landing on the anchor member 20 during operating conditions and being injured. Such a distal end 25 maintains at least a minimum spatial distance with the ground surface during operating conditions, which is essential such that an arcuate portion of the support pole 24 does not downwardly bend beyond a minimum height defined between the distal end 25 and the ground surface. Such a minimum spatial distance maintains the rim section 23 at a sufficient height above a ground surface which is important for allowing proper use of the assembly 10 during operating conditions. A rim section 23 is statically attached to the distal end 25 of the support pole 24 via threaded fasteners.

Referring to FIGS. 1, 2, 3, 4, 6, the assembly 10 further includes a mechanism 26 for illuminating the rim section 23 and the support pole 24 when an external force is applied to the rim section 23. The rim section and the support pole illuminating mechanism 26 includes a first plurality of illuminable elements 27 embedded within the rim section 23 and traveling about an entire circumference thereof. A second plurality of illuminable elements 28 is embedded within the support pole 24 and travels along a major longitudinal length thereof. An elongated flange 29 advantageously extends rearwardly from the rim section 23 and has a posterior end 30 adjustably seated within the distal end 25 of the support pole 24. First 31 and second 32 deformably resilient spring members are nested within the support pole 24 and attached directly to the flange 29, without the use of intervening elements, which is critical to thereby advantageously maintain the rim section 23 at the equilibrium position defined centrally within the support pole 24.

Figure 2:
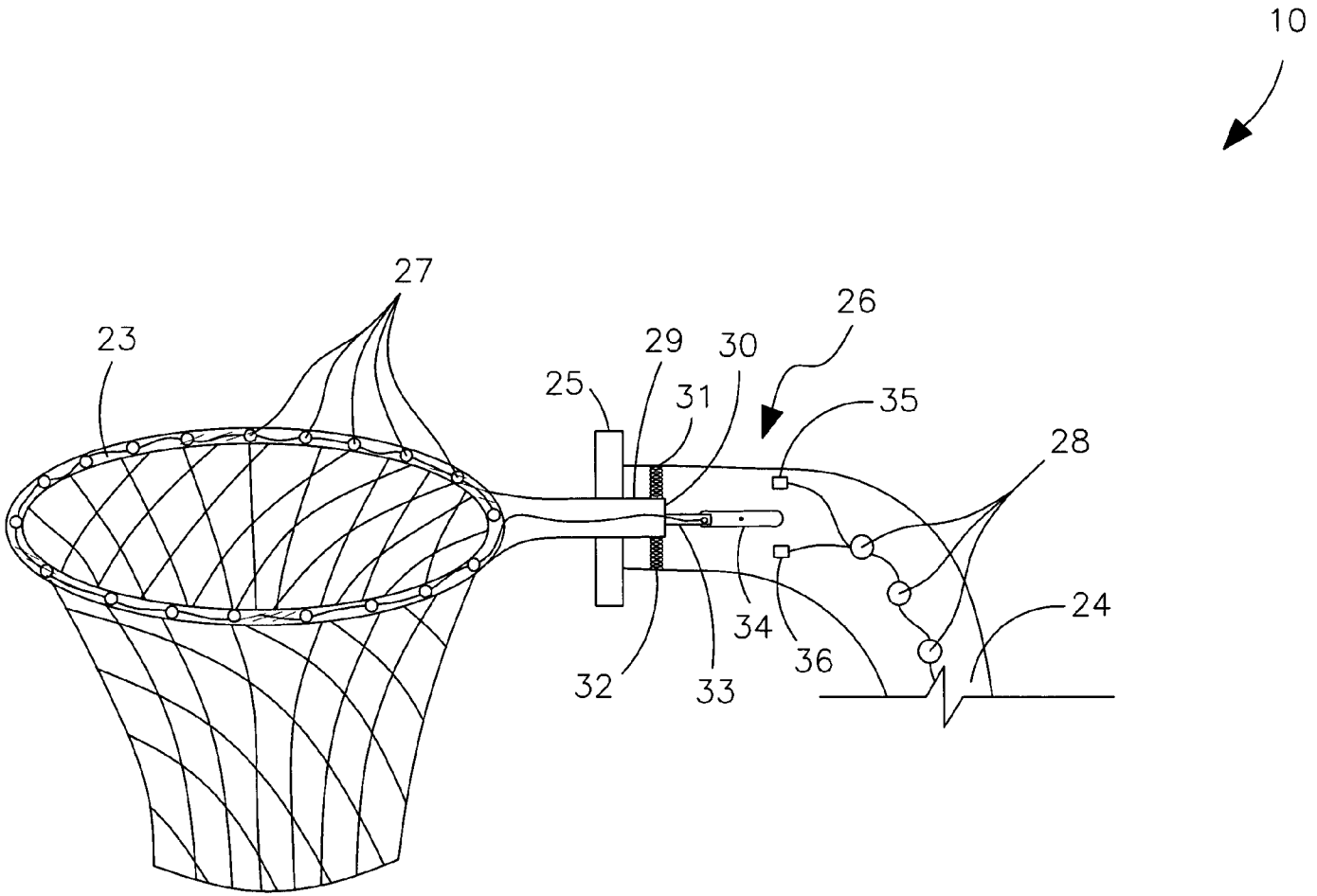
FIG. 2 is an interior view of the rim section and support pole illuminating mechanism, taken along line 2-2.
Figure 3:
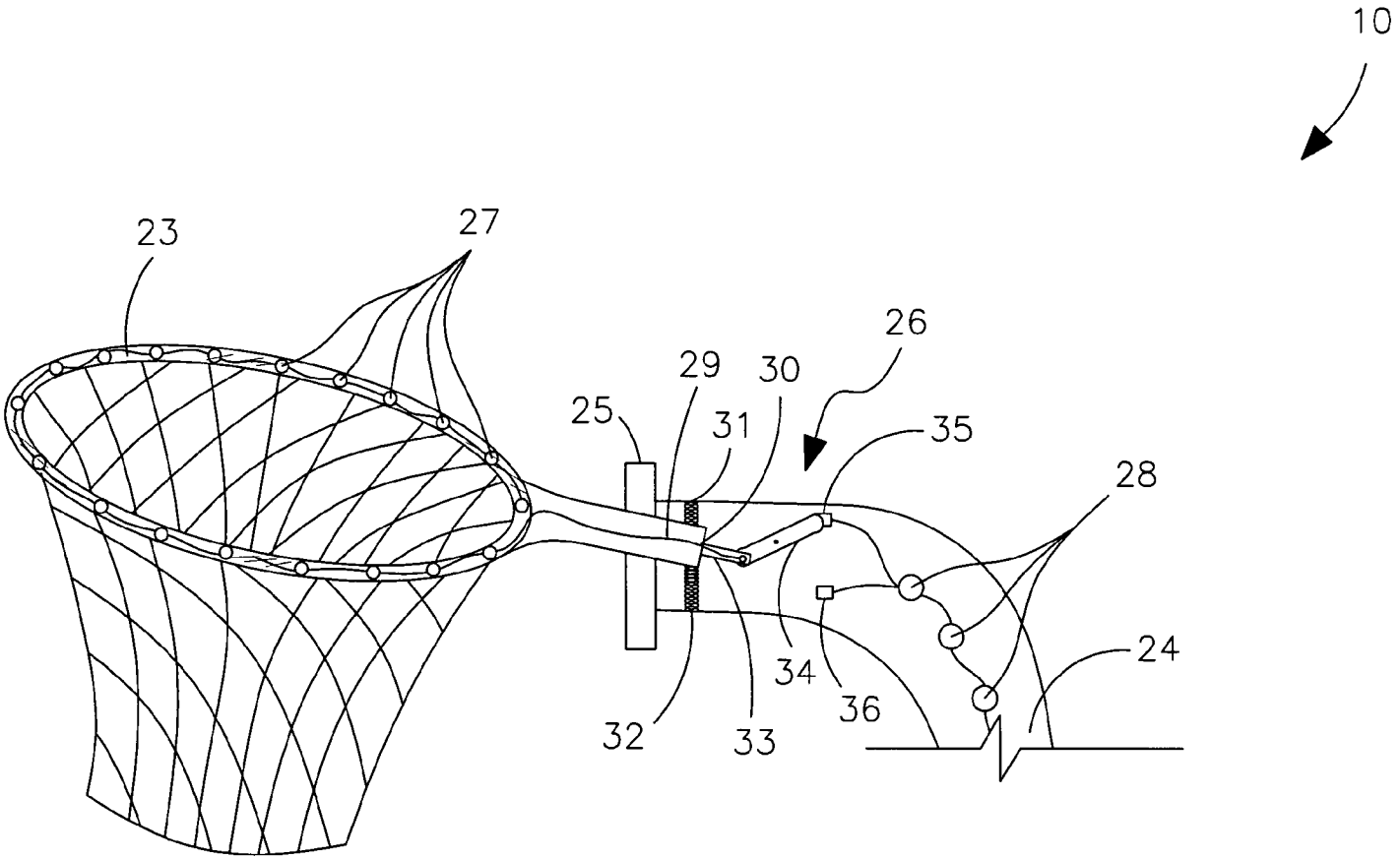
FIG. 3 is an interior view of the mechanism shown in FIG. 2 showing the articulating arm contacting the first conductive contact.
Figure 4:
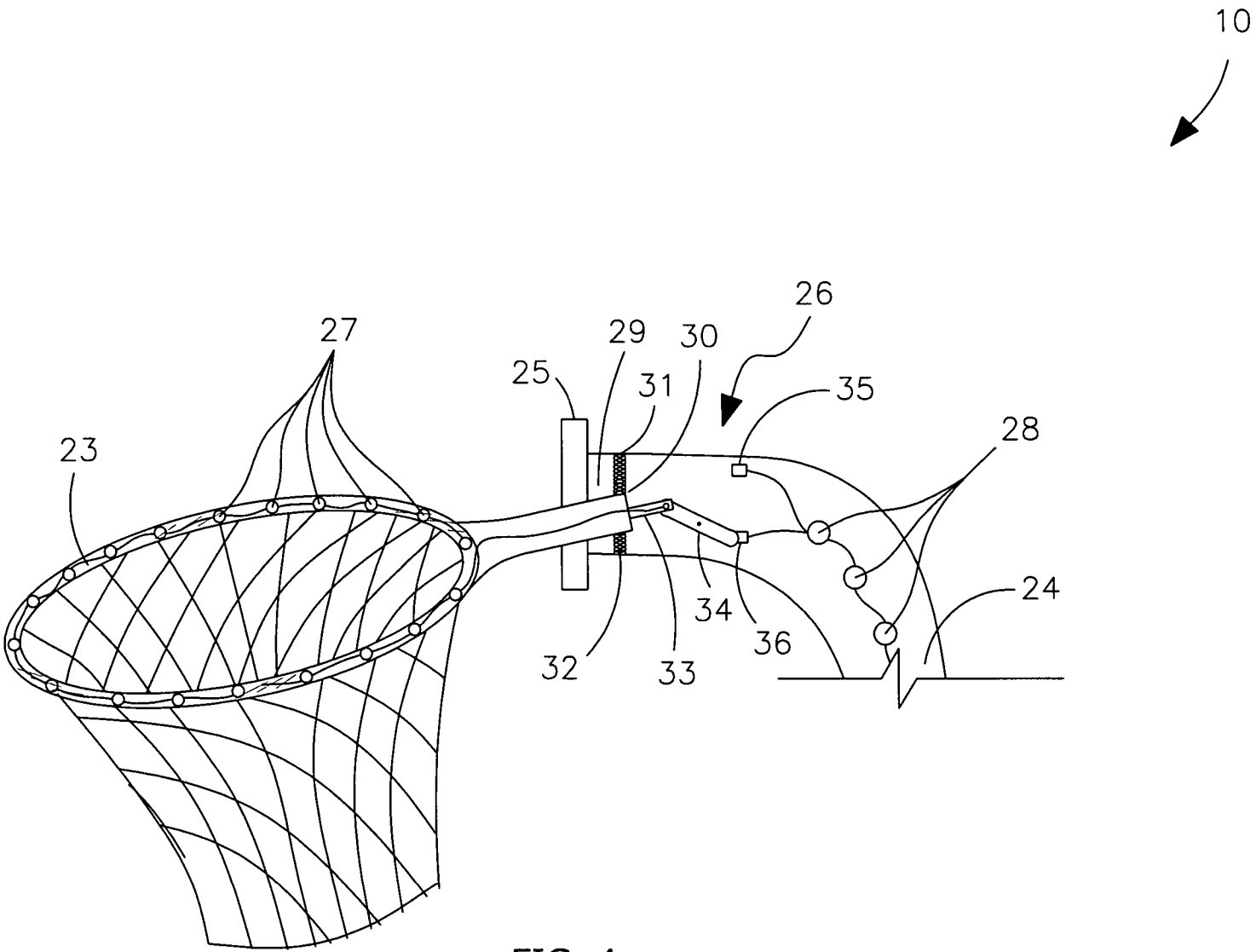
FIG. 4 is an interior view of the mechanism shown in FIG. 2 showing the articulating arm contacting the second conductive contact.
Figure 5:
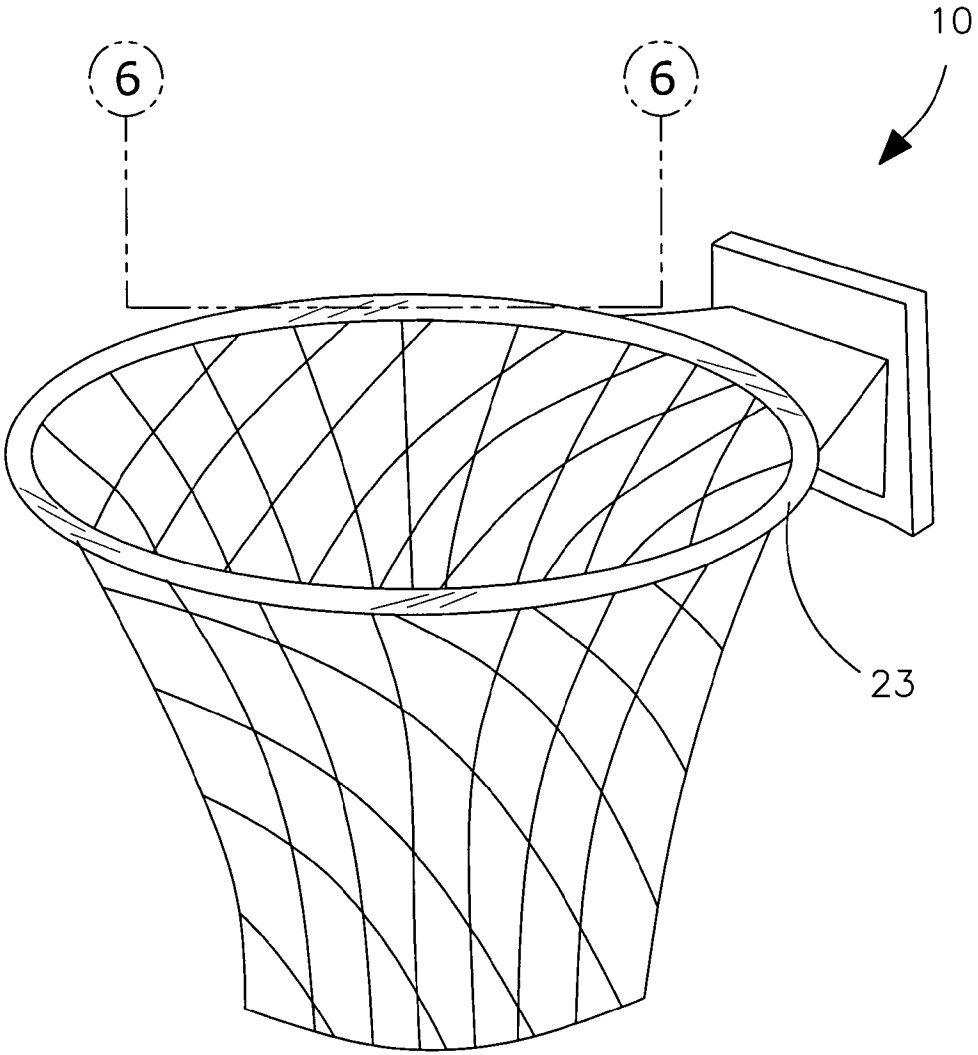
FIG. 5 is a perspective view of the rim section.
Figure 6:
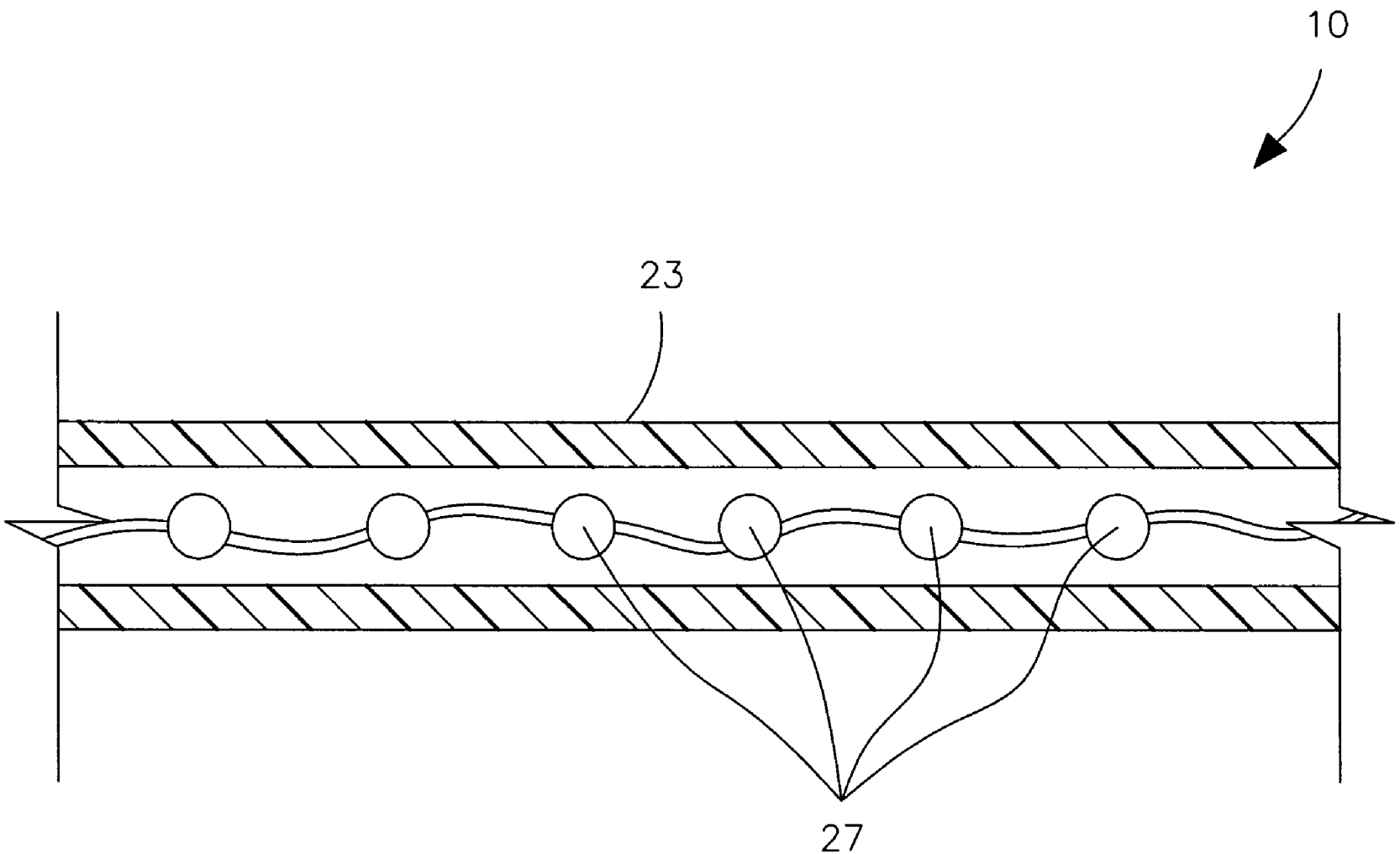
FIG. 6 is a cross sectional view of the rim section shown in FIG. 5, taken along line 6-6.
Figure 7:
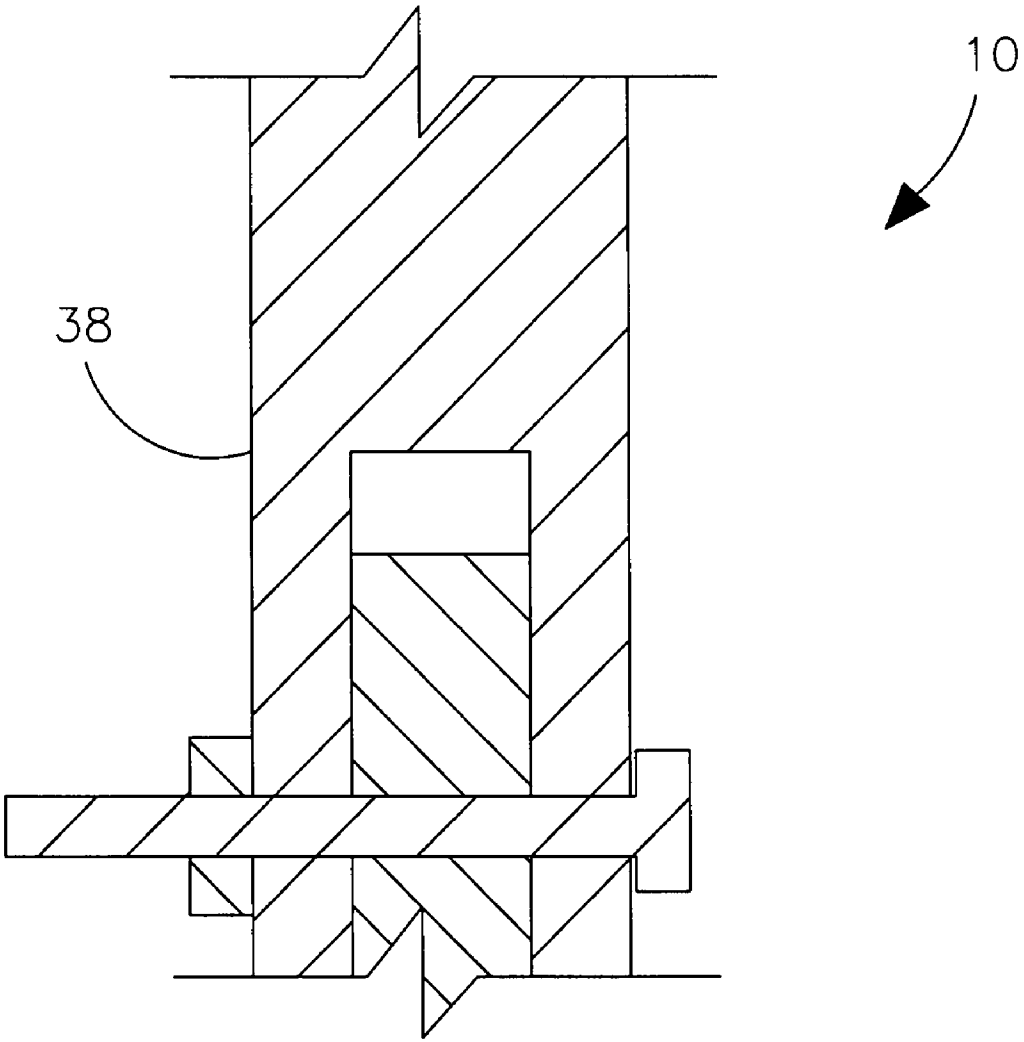
FIG. 7 is a cross sectional view of the shaft and support pole respectively, taken along line 7-7.
Figure 8:
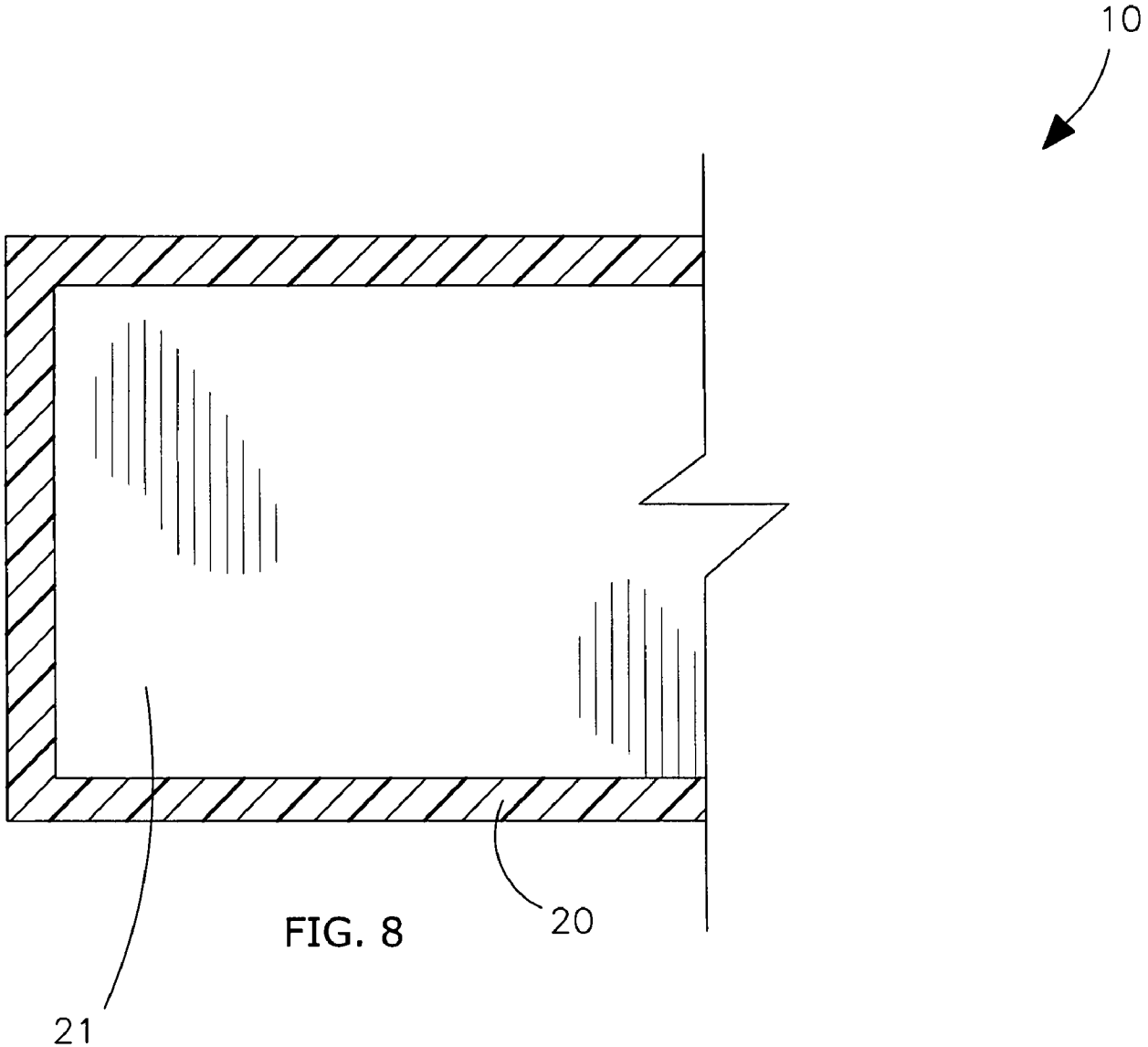
FIG. 8 is a cross sectional view of the anchor member, taken along line 8-8.
Figure 9:
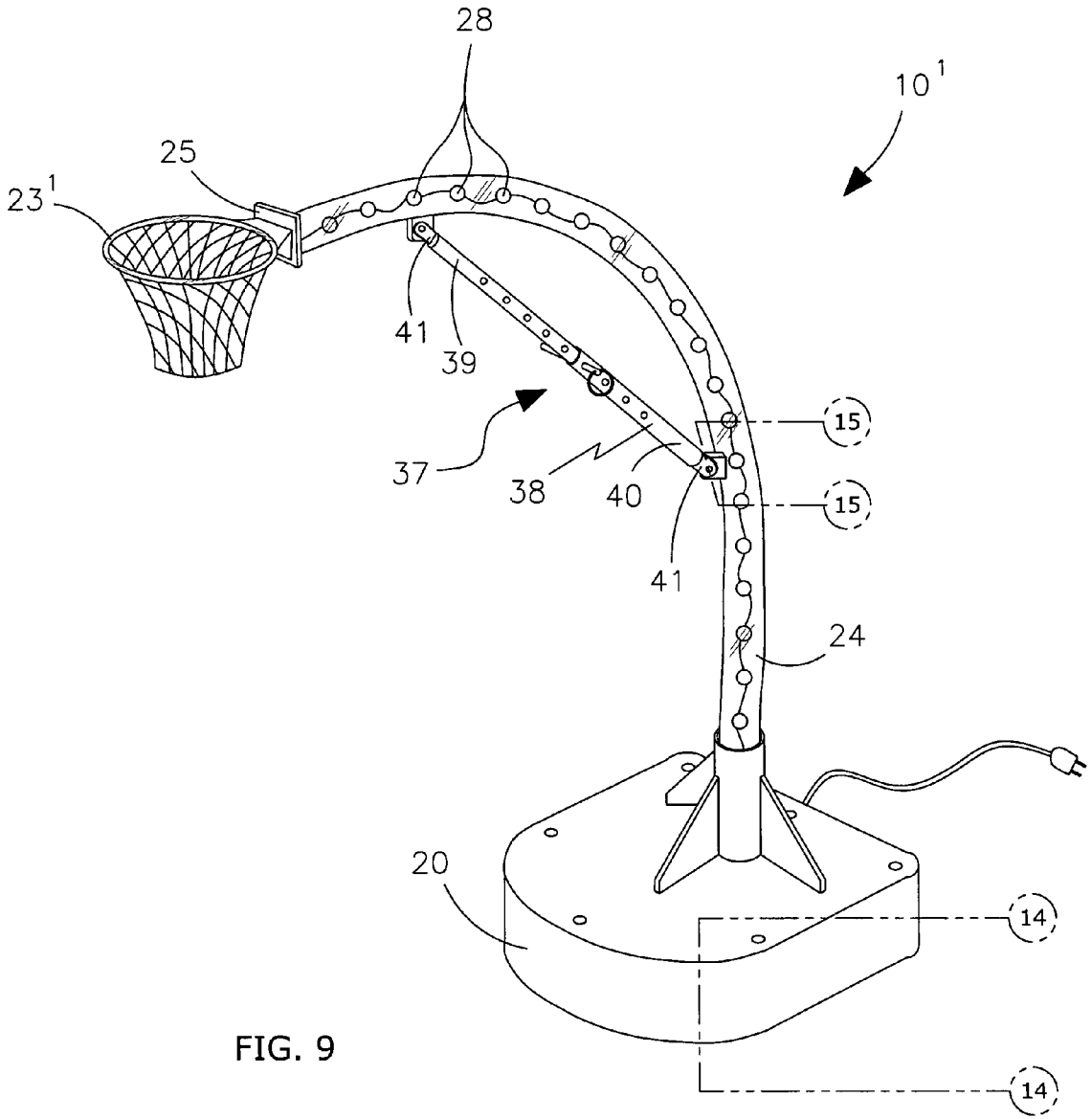
FIG. 9 is a perspective view of an illuminable portable basketball rim assembly, in an alternate embodiment.

Referring to FIGS. 2, 3 and 4, the rim section and the support pole illuminating mechanism 26 further includes an extension member 33 statically anchored directly to the flange 29, without the use of intervening elements, and extending rearwardly therefrom while seated within the support pole 24, and an actuating arm 34 pivotally housed within the support pole 24 and directly coupled to the extension member 33, without the use of intervening elements. First 35 and second 36 conductive contacts are statically disposed within the support pole 24 and equidistantly spaced from the actuating arm 34 when the actuating arm 34 is rested at the equilibrium position. Such spacing allows the contacts 35, 36 to absorb the shock of contacting the actuating arm 34 without being damaged.

Again referring to FIGS. 2, 3 and 4, the first and second spring members 31, 32 respectively compress and expand when the external force acts upon the rim section 23 to thereby advantageously pivot the actuating arm 34 about an axis defined perpendicular to the flange 29 and engage one of the first and second conductive contacts 35, 36 so that a continuous electrical connection is created between the first and second plurality of illuminable elements 27, 28. Such a connection initiates illumination of the plurality of elements 27, 28 and provides a visual expression thereof along the rim section 23 and the support pole 24.

Referring to FIGS. 1, 7, 9 and 15, a mechanism 37 advantageously maintains the support pole 24 at a stable and equilibrium position, which is crucial such that the distal end 25 of the support pole 24 is prohibited from displacing downwardly beyond a predefined height. Such a prohibition prevents the rim section 23 from being positioned too close to the ground surface, and thereby rendering the invention 10 useless for its' intended purpose. Such a support pole maintaining mechanism 37 includes a rectilinear shaft 38 including telescopically engaged male 39 and female 40 members. Each of such male and female members 39, 40 includes a distal end 41 pivotally attached to the support pole 24, which is essential such that a longitudinal length of the shaft 38 is advantageously maintained at a fixed position during operating conditions, which is critical for prohibiting the support pole 24 from bending beyond a predetermined threshold. The distal end 41 of the male member 39 is disposed proximate to the distal end 25 of the support pole 24.

Figure 10:
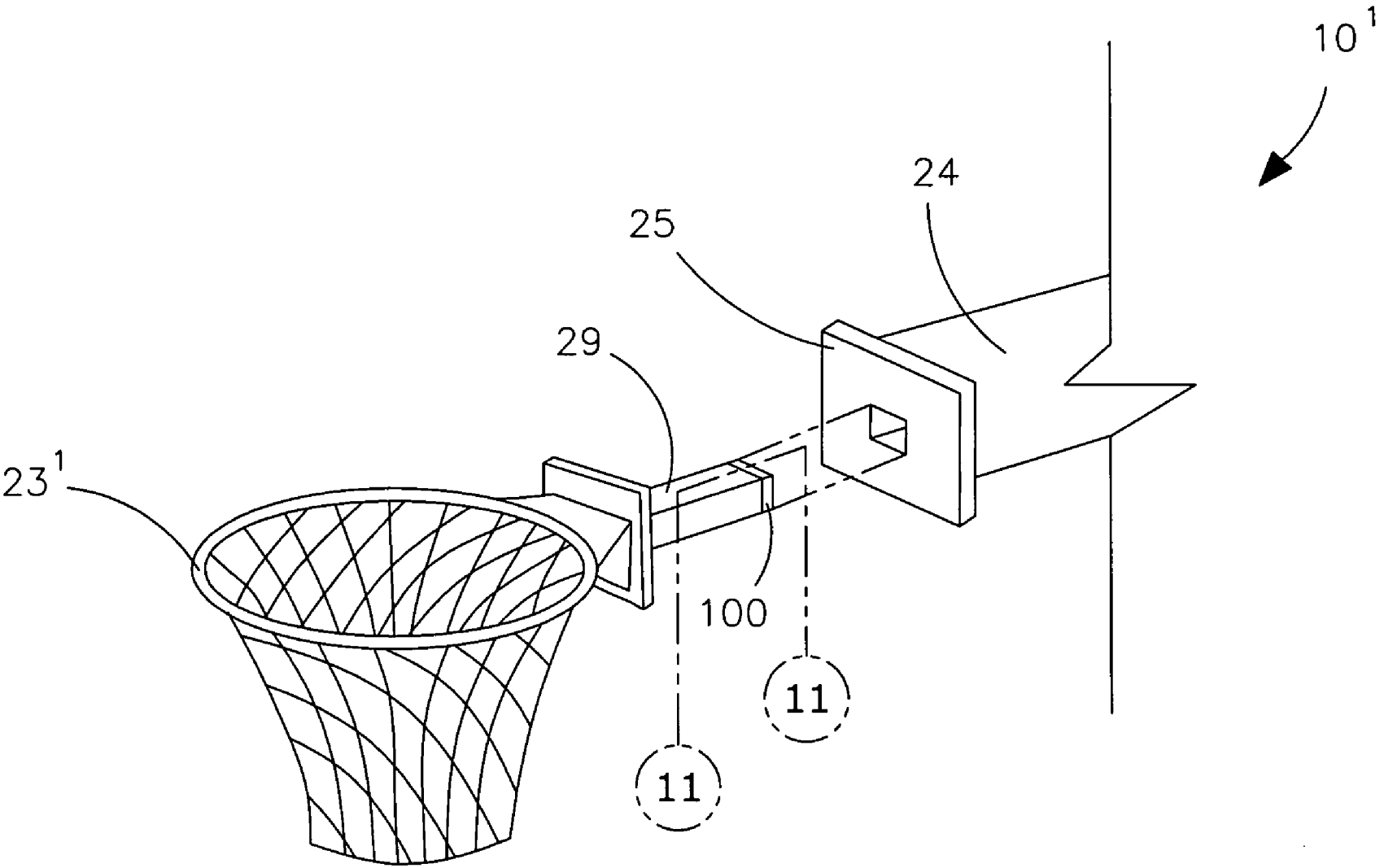
FIG. 10 is an exploded perspective view of the rim section, in an alternate embodiment.
Figure 11:
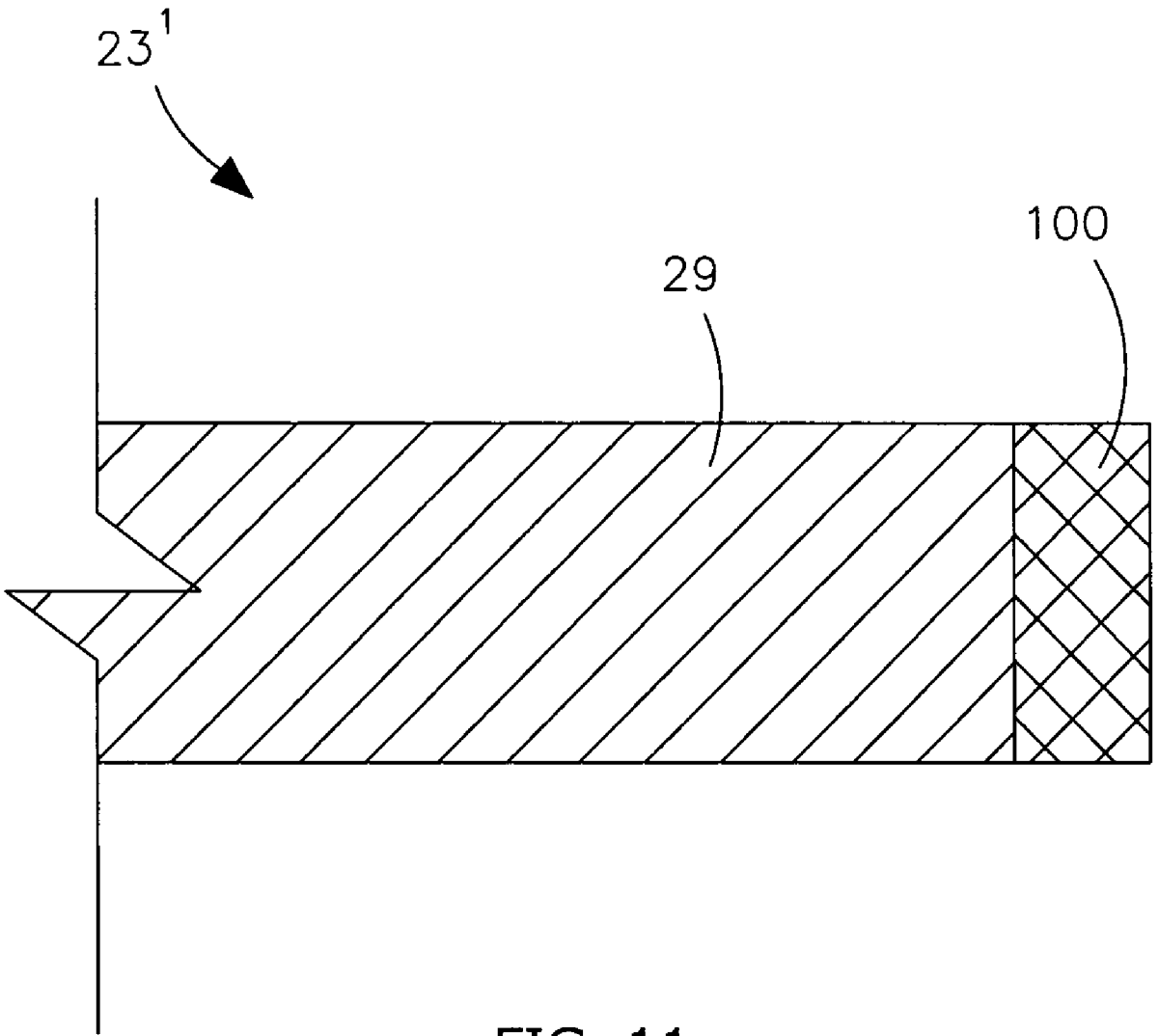
FIG. 11 is a cross sectional view of the rim section in FIG. 10, taken along line 3-3.
Figure 12:
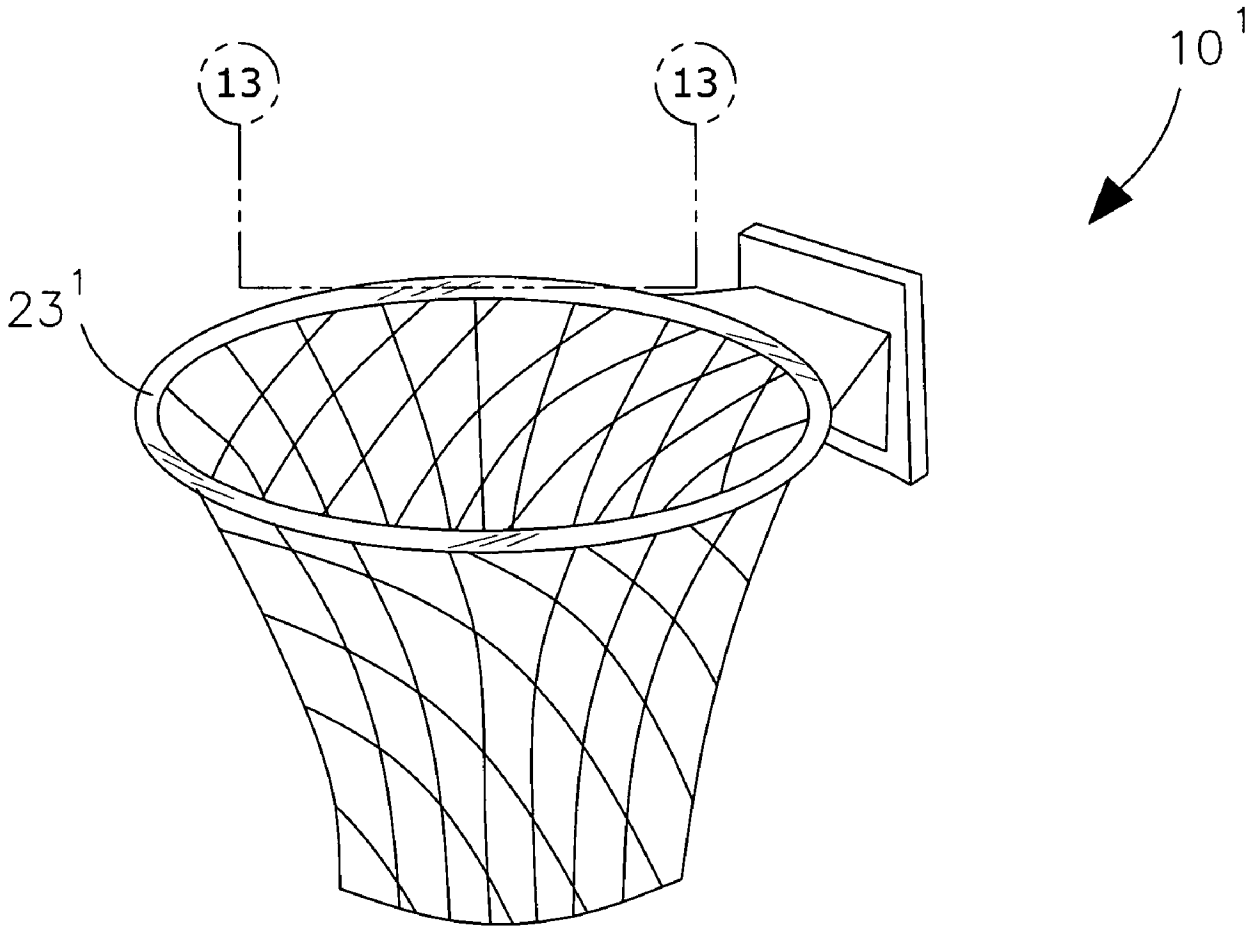
FIG. 12 is a perspective view of the rim section.
Figure 13:
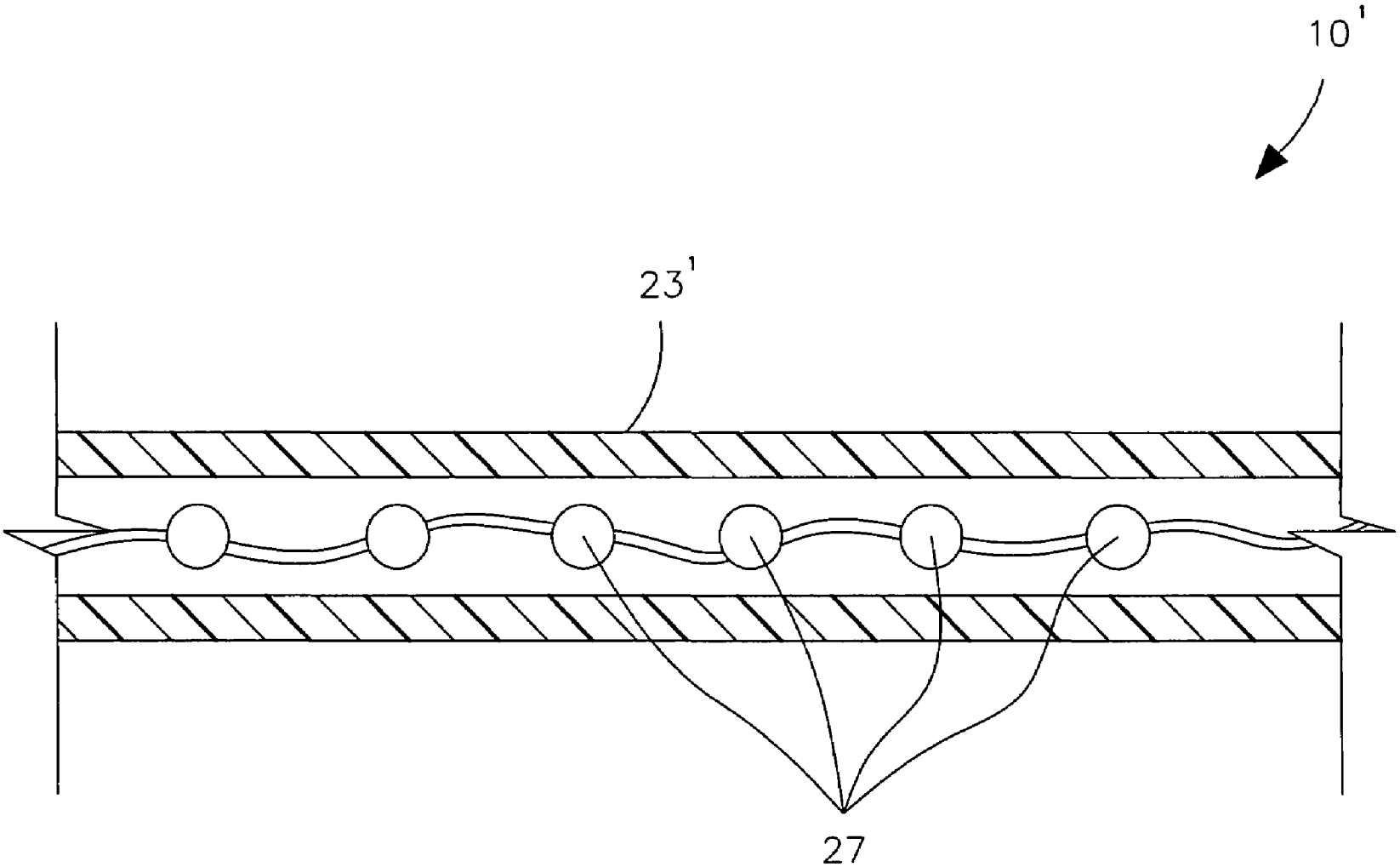
FIG. 13 is a cross sectional view of the rim section shown in FIG. 12, taken along line 5-5.
Figure 14:
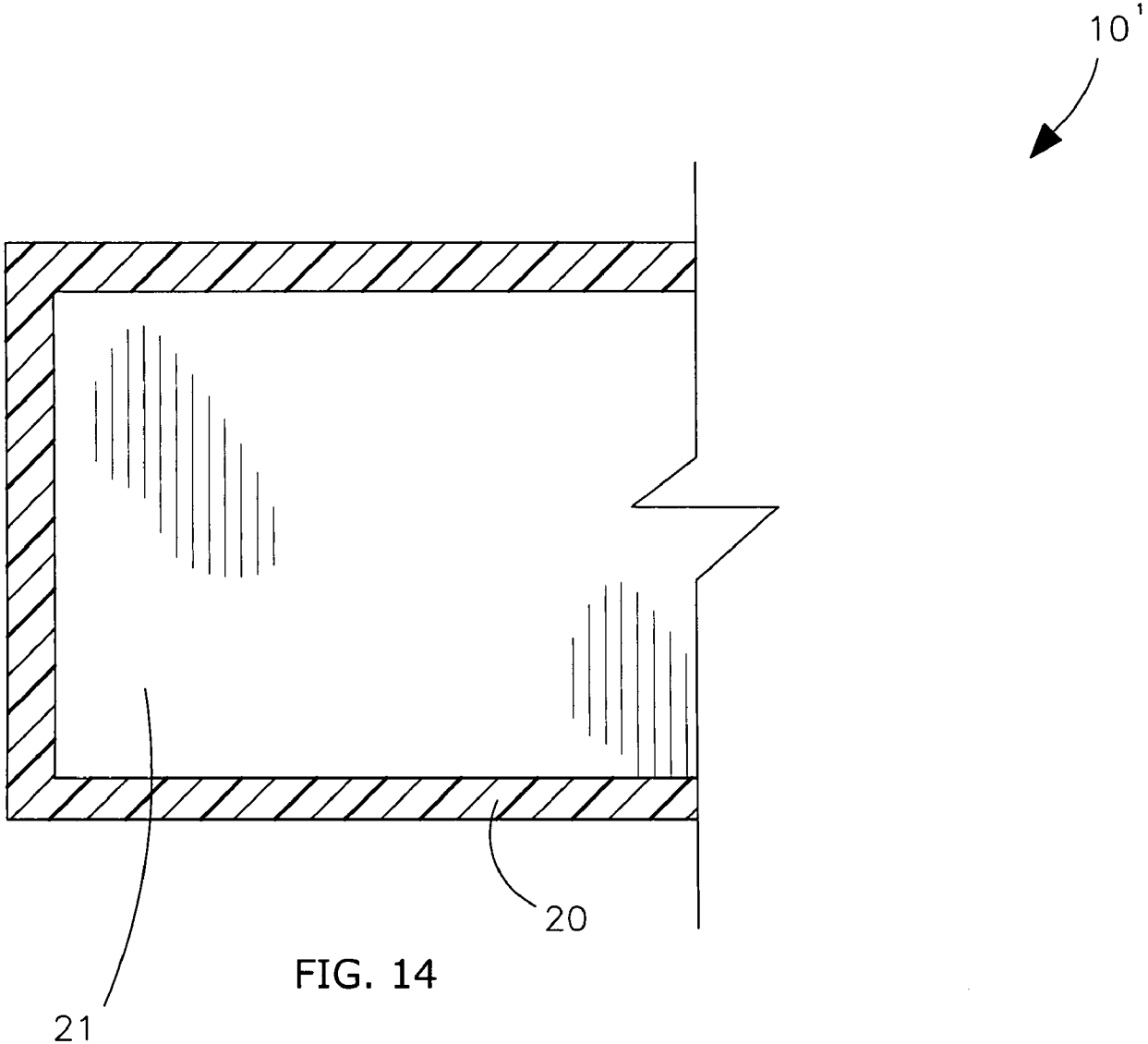
FIG. 14 is a cross sectional view of the anchor member, taken along line 14-14.
Figure 15:
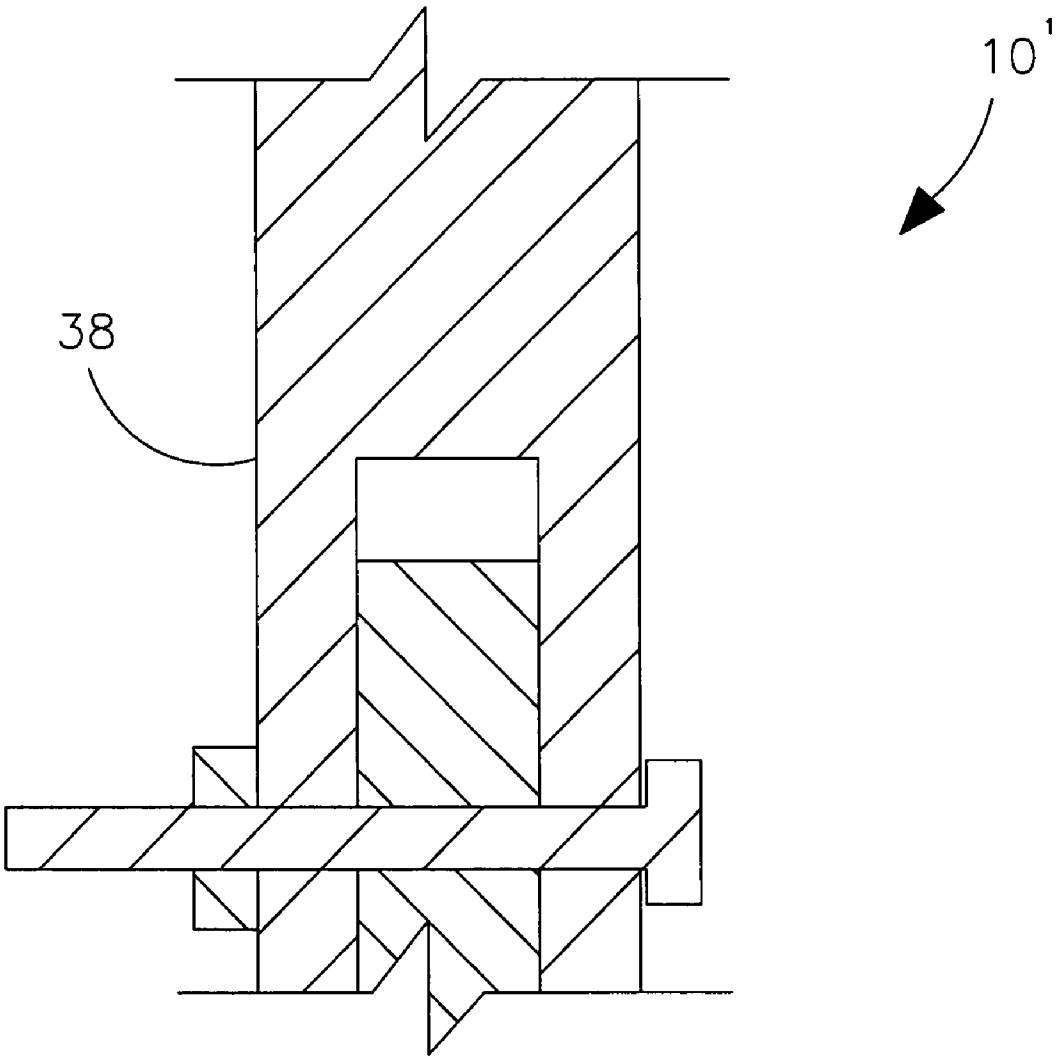
FIG. 15 is a cross sectional view of the shaft and support pole, taken along line 15-15.

Referring to FIGS. 10, 11 and 13 in an alternate embodiment 10', the rim section 23' includes a magnet 100 integrally connected to the posterior end 30 of the flange 29 for removably attaching the rim section 23 to the distal end 25 of the support pole 24. The rim section 23' is attachable and removable without the use of hand tools, thereby allowing for faster assembly and disassembly of the invention 10'. In this embodiment 10', the second plurality of illuminable elements 28 is illuminated continuously when the assembly 10' is plugged into a power outlet.

In use, the illuminable portable basketball rim assembly 10 and 10' is simple and straightforward to use. First, a user assembles the invention 10 and 10' according to package instructions. After assembling the invention 10 and 10', the user then places the assembly 10 and 10' in an area that provides unimpeded access to a power outlet, thereby activating the assembly 10 and 10'. When finished playing, the user simply unplugs the assembly 10 from the power outlet.

The rim section and support pole illuminating mechanism 26 of the assembly 10 provides the unexpected benefit of allowing a user to illuminate the rim section 23 and support pole 24, thereby allowing use of the invention 10 and 10' during low light conditions. In addition, such illumination provides a flashy and exciting means of positively identifying when a user has successfully scored during operating conditions. Also, the use of a magnetically attachable rim section 23', without a backboard, allows a user to assemble and disassemble the invention 10 and 10' more easily than with a traditional hoop assembly, and reduces the possibility of lost or damaged parts that would render the invention 10 and 10' useless for its' intended purpose. The above mentioned benefits overcome the previously noted prior art shortcomings.

In operation, a method for illuminating a basketball rim assembly 10 and 10' includes the steps of seating an anchor member 20 on a ground surface, and directly coupling a curvilinear and resiliently adaptable support pole 24 to the anchor member 20 and extending the support pole 24 upwardly therefrom. The anchor member 20 has a hollow cavity 21 filled with a weight agent, and the support pole 24 has a distal end 25 positioned anterior to the anchor member 20. The distal end 25 of the support pole 24 maintains at least a minimum spatial distance with the ground surface during operating conditions such that an arcuate portion of the support pole 24 does not downwardly bend beyond a minimum height defined between the distal end 25 and the ground surface. The method further includes the steps of positioning a rim section 23 at the distal end 25 of the support pole 24, illuminating the rim section 23 and the support pole 24 by applying an external force to the rim section 23, and maintaining the support pole 24 at a stable and equilibrium position such that the distal end 25 of the support pole 24 is prohibited from displacing downwardly beyond a predefined height.

The method further includes the steps of, providing a first plurality of illuminable elements 27 embedded within the rim section 23 and traveling about an entire circumference thereof, providing a second plurality of illuminable elements 28 embedded within the support pole 24 and traveling along a major longitudinal length thereof, providing an elongated flange 29 extending rearwardly from the rim section 23 that has a posterior end 30 adjustably seated within the distal end 25 of the support pole 24, and providing first and second deformably resilient spring members 31, 32 nested within the support pole 24 and attached directly to the flange 29 to thereby maintain the rim section 23 at the equilibrium position defined centrally within the support pole 24.

The method further includes the steps of providing an extension member 33 statically anchored directly to the flange 29 and extending rearwardly therefrom while seated within the support pole 24, providing an actuating arm 34 pivotally housed within the support pole 24 and directly coupled to the extension member 33, and providing first and second conductive contacts 35, 36 statically disposed within the support pole 24 and equidistantly spaced from the actuating arm 34 when the actuating arm 34 is rested at the equilibrium position. Such first and second spring members 31, 32 respectively compress and expand when the external force acts upon the rim section 23 to thereby pivot the actuating arm 34 about an axis defined perpendicular to the flange 29 and engage one of the first and second conductive contacts 35, 36 so that a continuous electrical connection is created between the first and second plurality of illuminable elements 27, 28.

The method further includes the steps of providing a rectilinear shaft 38 by telescopically engaging male 39 and female 40 members. Each of such male and female members 39, 40 includes a distal end 41 pivotally attached to the support pole 24 such that a longitudinal length of the shaft 38 is maintained at a fixed position during operating conditions for prohibiting the support pole 24 from bending beyond a predetermined threshold While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An illuminable basketball rim assembly for providing user enjoyment in space-limited areas, said illuminable basketball rim assembly comprising:

an anchor member seated on a ground surface;

a curvilinear and resiliently adaptable support pole directly coupled to said anchor member and extending upwardly therefrom, said support pole having a distal end positioned anterior to said anchor member, said distal end maintaining at least a minimum spatial distance with the ground surface during operating conditions such that an arcuate portion of said support pole does not downwardly bend beyond a minimum height defined between said distal end and the ground surface;

a rim section positioned at said distal end of said support pole;

means for illuminating said rim section and said support pole when an external force is applied to said rim section; and means for maintaining said support pole at a stable and equilibrium position such that said distal end of said support pole is prohibited from displacing downwardly beyond a predefined height, wherein said rim section and said support pole illuminating means comprises:

a first plurality of illuminable elements embedded within said rim section and traveling about an entire circumference thereof;

a second plurality of illuminable elements embedded within said support pole and traveling along a major longitudinal length thereof;

an elongated flange extending rearwardly from said rim section and having a posterior end adjustably seated within said distal end of said support pole; and first and second deformably resilient spring members nested within said support pole and attached directly to said flange to thereby maintain said rim section at the equilibrium position defined centrally within said support pole.

2. The illuminable basketball rim assembly of claim 1, wherein said rim section and said support pole illuminating means further comprises:

an extension member statically anchored directly to said flange and extending rearwardly therefrom while seated within said support pole;

an actuating arm pivotally housed within said support pole and directly coupled to said extension member; and first and second conductive contacts statically disposed within said support pole and equidistantly spaced from said actuating arm when said actuating arm is rested at the equilibrium position;

wherein said first and second spring members respectively compress and expand when the external force acts upon said rim section to thereby pivot said actuating arm about an axis defined perpendicular to said flange and engage one of said first and second conductive contacts so that a continuous electrical connection is created between said first and second plurality of illuminable elements.

3. The illuminable basketball rim assembly of claim 1, wherein said support pole maintaining means comprises:

a rectilinear shaft including telescopically engaged male and female members, each of said male and female members including a distal end pivotally attached to said support pole wherein a longitudinal length of said shaft is maintained at a fixed position during operating conditions for prohibiting said support pole from bending beyond a predetermined threshold.

4. The illuminable basketball rim assembly of claim 3, wherein said distal end of said male member is disposed proximate to said distal end of said support pole.

5. The illuminable basketball rim assembly of claim 1, wherein said rim section includes a magnet integrally connected to said posterior end of said flange for removably attaching said rim section to said distal end of said support pole.

6. An illuminable basketball rim assembly for providing user enjoyment in space-limited areas, said illuminable basketball rim assembly comprising:

an anchor member seated on a ground surface, said anchor member having a hollow cavity filled with a weight agent;

a curvilinear and resiliently adaptable support pole directly coupled to said anchor member and extending upwardly therefrom, said support pole having a distal end positioned anterior to said anchor member, said distal end maintaining at least a minimum spatial distance with the ground surface during operating conditions such that an arcuate portion of said support pole does not downwardly bend beyond a minimum height defined between said distal end and the ground surface;

a rim section positioned at said distal end of said support pole;

means for illuminating said rim section and said support pole when an external force is applied to said rim section; and means for maintaining said support pole at a stable and equilibrium position such that said distal end of said support pole is prohibited from displacing downwardly beyond a predefined height wherein said illuminable rim section and said support pole illuminating means comprises: first plurality of illuminable elements embedded within said rim section and traveling about an entire circumference thereof; a second plurality of illuminable elements embedded within said support pole and traveling along a major longitudinal length thereof; an elongated flange extending rearwardly from said rim section and having a posterior end adjustably seated within said distal end of said support pole; and first and second deformably resilient spring members nested within said support pole and attached directly to said flange to thereby maintain said rim section at the equilibrium position defined centrally within said support pole.

7. The illuminable basketball rim assembly of claim 6, wherein said rim section and said support pole illuminating means further comprises:

an extension member statically anchored directly to said flange and extending rearwardly therefrom while seated within said support pole;

an actuating arm pivotally housed within said support pole and directly coupled to said extension member; and first and second conductive contacts statically disposed within said support pole and equidistantly spaced from said actuating arm when said actuating arm is rested at the equilibrium position;

wherein said first and second spring members respectively compress and expand when the external force acts upon said rim section to thereby pivot said actuating arm about an axis defined perpendicular to said flange and engage one of said first and second conductive contacts so that a continuous electrical connection is created between said first and second plurality of illuminable elements.

8. The illuminable basketball rim assembly of claim 6, wherein said support pole maintaining means comprises:

a rectilinear shaft including telescopically engaged male and female members, each of said male and female members including a distal end pivotally attached to said support pole wherein a longitudinal length of said shaft is maintained at a fixed position during operating conditions for prohibiting said support pole from bending beyond a predetermined threshold.

9. The illuminable basketball rim assembly of claim 8, wherein said distal end of said male member is disposed proximate to said distal end of said support pole.

10. The illuminable basketball rim assembly of claim 6, wherein said rim section includes a magnet integrally connected to said posterior end of said flange for removably attaching said rim section to said distal end of said support pole.

11. A method for illuminating the basketball rim assembly of claim 1 or claim 6 said method comprising the steps of:

a. seating an anchor member on a ground surface, said anchor member having a hollow cavity filled with a weight agent;

b. directly coupling a curvilinear and resiliently adaptable support pole to said anchor member and extending said support pole upwardly therefrom, said support pole having a distal end positioned anterior to said anchor member, said distal end maintaining at least a minimum spatial distance with the ground surface during operating conditions such that an arcuate portion of said support pole does not downwardly bend beyond a minimum height defined between said distal end and the ground surface;

c. positioning a rim section at said distal end of said support pole;

d. illuminating said rim section and said support pole by applying an external force to said rim section; and e. maintaining said support pole at a stable and equilibrium position such that said distal end of said support pole is prohibited from displacing downwardly beyond a predefined height.

12. The method of claim 11, wherein step d. further comprises the steps of:

i. providing a first plurality of illuminable elements embedded within said rim section and traveling about an entire circumference thereof;

ii. providing a second plurality of illuminable elements embedded within said support pole and traveling along a major longitudinal length thereof;

iii. providing an elongated flange extending rearwardly from said rim section and having a posterior end adjustably seated within said distal end of said support pole; and iv. providing first and second deformably resilient spring members nested within said support pole and attached directly to said flange to thereby maintain said rim section at the equilibrium position defined centrally within said support pole.

13. The method of claim 12, wherein said step d. further comprises the steps of:

v. providing an extension member statically anchored directly to said flange and extending rearwardly therefrom while seated within said support pole;

vi. providing an actuating arm pivotally housed within said support pole and directly coupled to said extension member; and vii. providing first and second conductive contacts statically disposed within said support pole and equidistantly spaced from said actuating arm when said actuating arm is rested at the equilibrium position;

wherein said first and second spring members respectively compress and expand when the external force acts upon said rim section to thereby pivot said actuating arm about an axis defined perpendicular to said flange and engage one of said first and second conductive contacts so that a continuous electrical connection is created between said first and second plurality of illuminable elements.

14. The method of claim 11, wherein step e. comprises the steps of:

i. providing a rectilinear shaft by telescopically engaging said male and female members, each of said male and female members including a distal end pivotally attached to said support pole wherein a longitudinal length of said shaft is maintained at a fixed position during operating conditions for prohibiting said support pole from bending beyond a predetermined threshold.

15. The method of claim 14, wherein said distal end of said male member is disposed proximate to said distal end of said support pole.

16. The method of claim 11, wherein said rim section is magnetically attached to said distal end of said support pole.

* * * * *